United States Patent [19]

Quang et al.

[11] 4,115,114

[45] Sep. 19, 1978

[54] ELECTROSTATIC CHARGE IMAGE TRANSFER

[75] Inventors: Pham Kim Quang, Dieppe; Jean-Claude Marckmann, Arques La Bataille, both of France

[73] Assignee: La Cellophane, Paris, France

[21] Appl. No.: 397,360

[22] Filed: Sep. 14, 1973

[30] Foreign Application Priority Data

Sep. 21, 1972 [FR] France ..... 72 33401

[51] Int. Cl.[2] ..... G03G 13/044

[52] U.S. Cl. ..... 96/1.4; 96/1 TE; 427/14; 427/17

[58] Field of Search ..... 96/1 R, 1 TE, 1.4; 117/17.5, 37 LE; 427/14, 17

[56] References Cited

U.S. PATENT DOCUMENTS

| | | | |
|---|---|---|---|
| 2,817,277 | 12/1957 | Bogdonoff | 96/1 TE |
| 3,551,146 | 12/1970 | Gundlach | 117/17.5 X |
| 3,556,784 | 1/1971 | Robinson et al. | 96/1 R X |
| 3,666,458 | 5/1972 | Arneth et al. | 96/1 TE |
| 3,703,376 | 11/1972 | Gundlach et al. | 96/1 R |
| 3,738,855 | 6/1973 | Gundlach | 96/1 R X |
| 3,783,352 | 1/1974 | Soma et al. | 96/1 R X |
| 3,820,985 | 6/1974 | Gaynor et al. | 427/14 X |
| 3,843,361 | 10/1974 | Gaynor | 96/1 R X |

*Primary Examiner*—Roland E. Martin, Jr.
*Attorney, Agent, or Firm*—Sherman & Shalloway

[57] ABSTRACT

A system for electrostatic reproduction in which a carrier surface is charged with an image, the image-charged surface is presented adjacent a receiving surface, and a liquid or powder developer is selectively charged and is presented between the image-charged surface and the receiving surface to produce a developed image on the receiving surface.

5 Claims, 4 Drawing Figures

ELECTROSTATIC CHARGE IMAGE TRANSFER

BACKGROUND OF THE INVENTION

The present invention relates to the electrostatic reproduction of images and is more particularly concerned with the reproduction of images by the transfer of charges from a carrier surface to an adjacent receiving surface in the presence of a charged developer.

BRIEF DISCUSSION OF THE PRIOR ART

A variety of electrostatic reproduction systems are available and include direct image-charging and indirect or image-transfer procedures.

In direct image-charging systems, an image of charges is produced on a receiving sheet, and the latent image is then developed and fixed to produce the finished copy.

In image-transfer systems, the charged image is produced on an intermediate or carrier surface, the image is pigmented by a developer, and the pigment image is tranferred to the receiving sheet for fixing and drying.

While these systems are functional for many requirements, they have been found to be problematical in copying images which include very fine lines and in terms of uniformity of background and accuracy of reproduction.

Another system has been employed in which the image-charge is transferred to a receiving sheet, instead of a pigmented image, and the transferred image-charge on the receiving is then developed and finished.

While these image-charge systems enjoy certain advantages, they require the maintenance and accurate control of sometimes difficult electrical fields at the zone of transfer of the image-charge, and require specific materials especially formed or treated for use in the system.

Therefore, the presently known systems have not been found to be entirely satisfactory in all respects.

SUMMARY OF THE INVENTION

In general, the preferred method of the present invention comprises establishing an image-charge on a carrier surface, and supplying selectively charged developer between the associated surfaces to induce a pigmented image on the receiving surface.

In general, the preferred form of apparatus of the present invention includes a carrier belt, means for establishing an image-charge on the carrier belt, an associating station for associating the image-charge area of the carrier belt adjacent and spaced from a receiving surface, and means for presenting a developing liquid or powder of selected charge to the associated areas of the carrier belt and the receiving surface.

OBJECTS OF THE INVENTION

Accordingly it is an object of the invention to provide an electrostatic reproduction system in which a pigmented image is induced in a receiving surface by a charge-image on a carrier surface.

A further object of the invention is the provision of an electrostatic reproduction system in which image-charges can be transferred between carrier and receiving surfaces without the need for electrical fields to control the transfer of the image.

It is a further object of the invention to provide an electrostatic reproduction system which can induce pigmented images in any suitable receiving surface without the need for critical preparation or treatment of the receiving surface.

An additional object of the invention is the provision of an electrostatic reproduction system which may employ either photoconductive or dielectric carrier surfaces to receive a charge-image, and induce pigmented images from the charge image in ordinary receiving surfaces.

BRIEF DESCRIPTION OF THE DRAWINGS

These and other objects of the invention will be more readily understood from the following description and the accompanying drawings, in which.

DETAILED DISCUSSION OF THE PREFERRED METHOD

Figure 1:
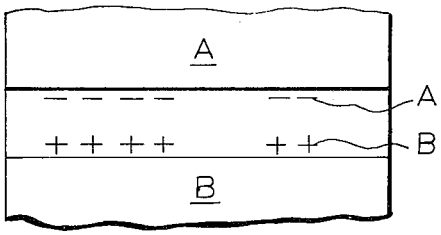
FIG. 1 is a schematic view showing the mechanism of induced electrostatic charges.

The preferred method of the present invention may be best understood by reference to FIG. 1. As shown, two bodies A and B are placed in close proximity to each other but are separated by a small distance.

If, for example, the carrier body A carries localized negative charges "A−," similarly localized positive charges "B+" are induced in the receiving body B opposite the negative charges A−.

Assuming that the body A is a photoconductive surface having the negative charges A− thereon in the form of a charged image, and assuming that the body B is a sheet of ordinary paper, it is apparent that the paper B carries an induced image formed by the charges B+.

However, the B+ image is not permanent and therefore, will exist on the paper only as long as the surfaces A and B are in close proximity.

Therefore, having associated the surfaces A and B, we have found that a pigmented image can be formed on (paper) B by presenting a negatively-charged developer liquid or powder in the zone between the two bodies. If a positively charged developer were to be presented, a pigmented direct image would be formed on the image carrier body A and a pigmented negative image induced on body B.

In either case, either a pigmented direct image or a pigmented negative image is induced on the paper B, which pigmented image can then be fixed in a conventional manner.

The initial image on the body A can be formed in any known manner. Where the body A is selected for electrophotographic image, it may be a photoconductive surface such as selenium, zinc oxide, cadmium sulfide, polyvinyl carbazole, or another known photoconductor. Where desired, the body A may be chosen as a dielectric surface and imaged by any suitable process for image-charging a dielectric surface.

It is of especial importance and an advantage of the present invention that the receiving surface of the body B may take many standard forms without special treatment. Therefore, the receiving surface of B can be a metallic strip, a plastic film which can be either opaque or transparent, or ordinary paper.

In practice, the carrier and receiving surfaces are to be brought into very close, but non-contacting association. We have found that a gap of 250 microns should be the maximum, since the intensity of the induced charges with images becomes inadequate at spacings greater than that dimension. On the other hand, a minimum practical distance is not as well defined, since any spacing, short of actual contact and consequent lack of access by the developer pigment, can be employed.

The proper potential of the charge-image on the carrier surface will depend on several factors, including the nature and the characteristics of the carrier layer itself. Of course, the potential must be sufficient to induce a clear and well established charge image on the receiving surface.

It has been found that 150 volts, which is within the limits of present-day photoconductive materials, is quite a successful potential as long as the carrier and receiving surfaces are not associated at greater than the 250 micron spacing.

The developer to be used in the method of the present invention is not critical. Currently available developers are suitable, whether in the form of loose pigment powder or a liquid suspension of pigment particles. The concentration of the particles is not critical, but may be varied in accordance with the potential of the charge-image. Furthermore, the developer may be in the form of an aerosol or gaseous suspension of particles.

Once established, the pigment image of the receiving surface is fixed, dried or otherwise conventionally finished into a permanent copy.

A successful modification of the method of the present invention includes the use of a direct image-transfer of the pigment image, from the receiving surface to a second receiving surface. In this method, the first receiving surface may be metallic or plastic drum or belt which then presses or contacts a second receiving surface such as a paper sheet. This method can be of special advantage where it is desirable to prevent wetting of the final copy surface, as can occur with liquidsuspended developers.

In practical application and use, it is preferred that the pigment image be established progressively, instead of simultaneously establishing the entire image. Preferably, this is accomplished by associating the carrier and receiving surfaces over spaced rollers. The two surfaces are then passed, at uniform speeds, between the spaced rollers. The speed of the surfaces can affect the contrast of the final image. However, under the conditions set forth above, it is possible to operate satisfactorily at speeds up to 0.5 meters/sec. The actual speed limit of a given system may be affected, however, by the rate of deposition of pigment from the developer.

DETAILED DESCRIPTION OF THE PREFERRED APPARATUS

Figure 2:
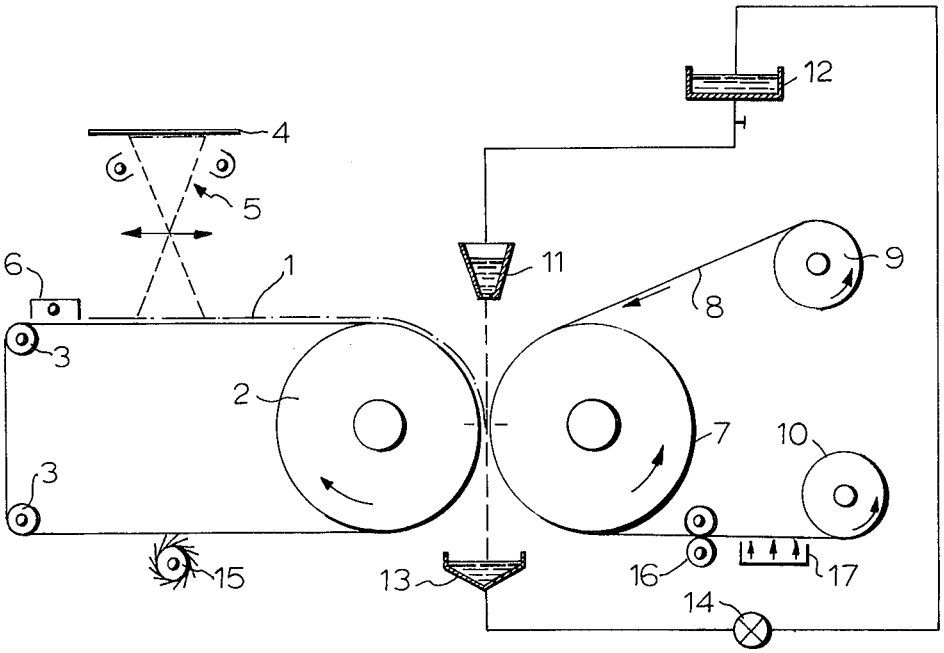
FIG. 2 is a schematic view of a preferred system for carrying out the present invention.

As shown in FIG. 2, the preferred form of apparatus of the invention includes a photoconductive carrier belt 1 (analogous to the body A of FIG. 1) which is moveably mounted on a drum 2 and rollers 3 and 3a and is positioned to receive a latent image of an original image 4 by means of an exposure unit 5, after having been negatively charged by a corona unit 6.

The drum 2 is continuously driven, by conventional means not shown, and presents the moving carrier belt adjacent a second drum 7 of equal diameter and speed as the drum 2. The drum 7 presents a receiving surface (analogous to the body B of FIG. 1) in the form of a strip of ordinary paper 8 which is fed from a reel 9 and taken up by a reel 10.

The drums 2 and 7, at closest points of their peripheries, present the carrier belt surface and the paper surface immediately adjacent each other. As discussed hereinbefore, this spacing "C-C" should not exceed 250 microns.

A negatively charged liquid developer is presented as a screen to the minute interval C-C from a distributor 11 which is supplied by a feed tank 12. Excess developer passing the gap or interval C-C is collected in a trough 13 and recycled to the feed tank 12 by means of a pump 14.

Preferably, the carrier belt is subjected to a cleaning, such as by a brush 15, to remove the opposite image which develops thereon simultaneously with development of the desired pigment image on the paper receiving surface 8.

The desired pigmented image on the paper 8 is fixed and finished by conventional means such as drying rolls 16 and a heater 17.

Operation of the system of FIG. 2 conforms to the example discussed regarding FIG. 1, in that the latent image on the carrier belt 1 induces a positive charge-image on the paper 8 which attracts the pigment of the negatively charged developer. The pigmented image is then finished in a conventional manner.

Figure 3:
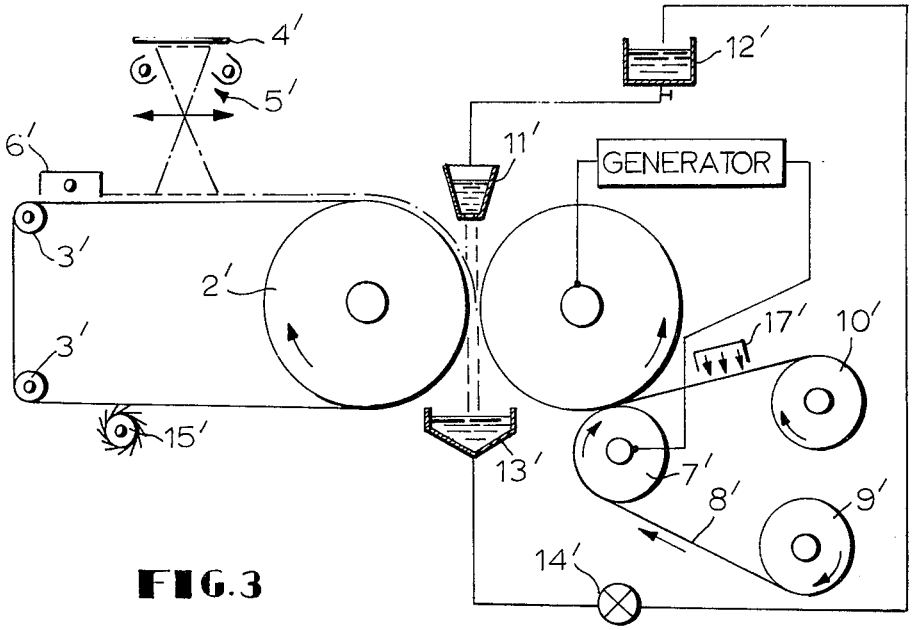
FIG. 3 is a schematic view of an modified embodiment of a system for carrying out the present invention.

As shown in FIG. 3, in which the same numerals, primed, have been used to denote elements similar to those of FIG. 2, the induced and pigmented image is established on an intervening receiving surface of a suitable drum 18, and is then transferred to the paper 8 by a pressing operation. The pressing transfer preferably is facilitated by means of a simple electrical field between the drums 7, and 18, which is established by any suitable means such as a corona unit or the DC generator shown.

In the system of FIG. 3, the critical spacing is maintained between the drum 2' and the drum 18, while the drum 18 is in actual transfer contact with the paper 8' on the surface of the drum 7'.

In operation of the system of FIG. 3, wetting of the paper 8' by the developer is not encountered, and only a fixing step is necessary. Otherwise, and with the exception of the press-transfer of the pigmented image from the drum 18 to the paper 8, the operation is similar to that of the system of FIG. 2.

Figure 4:
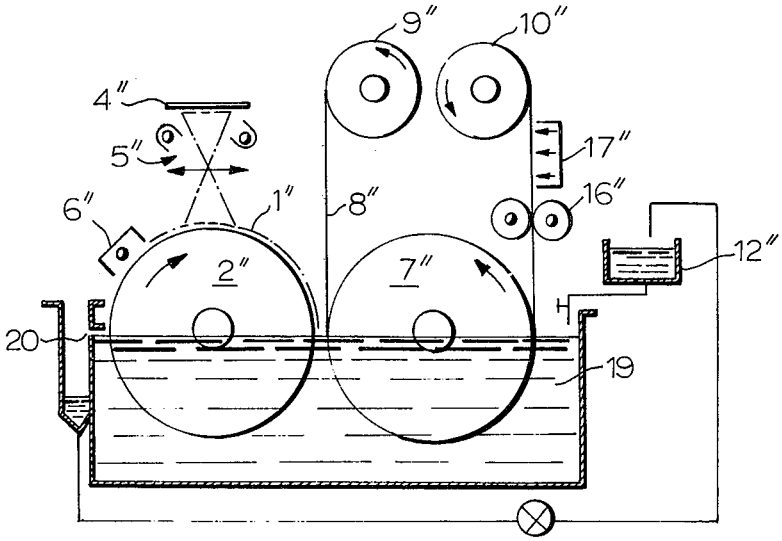
FIG. 4 is a schematic view of a further embodiment of a system according to the invention.

As shown in FIG. 4, in which the same numerals, doubleprimed, are used to denote elements similar to those of FIG. 2, a modified from fo the convention includes a bath 19 for presentation of the developer to the interval between the carrier surface 1'' and the paper receiving surface 8''.

In this form, the carrier surface 1'' is in the form of a selenium photoconductive layer on the drum 2'', instead of the carrier belt used in the system of FIG. 2.

The drums 2'' and 7'' are sufficiently immersed in the developer bath 19 to present the charged developer to the interval at which the image is induced on the paper receiving surface 8'' thereby producing a pigmented image on the paper.

The level of the bath 19 is fixed on an overflow 20 and is replenished by a supply tank 12''. Finishing of the pigmented image is accomplished by the rolls 16'' and the heater 17''.

Therefore, the present invention provides for simple and economical electrostatic reproduction systems which are operable with ordinary papers or copy bases and which produce high quality and high resolution copies. The systems produce simultaneous positive and negative pigmented images, either of which may be fixed and finished.

The developer is presented to the induced image as it is being formed, instead of before or after its formation as in prior systems.

The nature and the charging of the components of the systems are completely flexible and subject to choice. Where a negative charge-image is established on the carrier surface, the resulting (positive) induced image on the receiving surface is pigmented to a direct image by a negative-charge developer. Conversely, a negative-charge induced-image would become a pigmented negative image with the same charge developer. The variations and alternative choices are apparent, and it is further apparent that a wide chocie of system layout and system components is consequently available.

Therefore, various changes may be made in the details of the invention as disclosed without sacrificing the advantages thereof or departing from the scope of the appended claims.

What is claimed is:

1. A method for electrostatic reproduction comprising establishing a charge image on a carrier surface, associating said imaged carrier surface adjacent and spaced from a receiving surface a distance not exceeding 250 microns to induce a charge image on said receiving surface by the sole influence of the charge image on said carrier surface, presenting a charged developer between said associated spaced surfaces to pigment said images, maintaining a spaced relationship of said carrier and receiving surfaces, and thereafter fixing one of said images.

2. The method of claim 1 in which the induced pigmented image on the receiving surface is fixed.

3. The method of claim 1 in which the induced, pigmented image on the receiving surface is transferred to a second receiving surface and the transferred image is fixed.

4. The method of claim 1 in which the charged developer is projected between the associated surfaces.

5. The method of claim 1 in which the associated surfaces are immersed in said charged developer.

* * * * *